US005088546A

United States Patent [19]

Greanias et al.

[11] Patent Number: 5,088,546

[45] Date of Patent: Feb. 18, 1992

[54] VACUUM-ASSISTED COUNTER GRAVITY CASTING APPARATUS WITH VALVE TO PREVENT FLOW OF MELT FROM MOLD

[75] Inventors: Anthony C. Greanias, Saginaw; John G. Kubisch, Midland; James B. Mercer; Wilmer G. Schaeff, both of Saginaw, all of Mich.

[73] Assignee: General Motors Corporation, Detroit, Mich.

[21] Appl. No.: 749,626

[22] Filed: Aug. 19, 1991

Related U.S. Application Data

[63] Continuation of Ser. No. 698,456, May 10, 1991, abandoned.

[51] Int. Cl.[5] ..... B22D 18/06

[52] U.S. Cl. ..... 164/255; 164/63; 164/133; 164/337

[58] Field of Search ..... 164/255, 337, 63, 306, 164/119, 133

[56] References Cited

U.S. PATENT DOCUMENTS

| | | | |
|---|---|---|---|
| 3,032,841 | 5/1962 | Sylvester . | |
| 3,090,090 | 5/1963 | Woodburn, Jr. . | |
| 3,443,629 | 5/1969 | Ebeling | 164/339 |
| 3,529,657 | 9/1970 | Bucy | 164/257 |
| 3,532,154 | 10/1970 | Balevski et al. | 164/119 |
| 3,905,419 | 9/1975 | Tenner | 164/337 |
| 4,340,108 | 7/1982 | Chandley et al. | 164/63 |
| 4,589,466 | 5/1986 | Chandley et al. | 164/119 |
| 4,606,396 | 8/1986 | Chandley et al. | 164/255 |
| 4,658,880 | 4/1987 | Voss | 164/255 |
| 4,745,962 | 5/1988 | Mercer et al. | 164/255 |
| 4,862,945 | 9/1989 | Greanias et al. | 164/63 |
| 4,932,461 | 6/1990 | Schaffer et al. | 164/255 |
| 4,961,455 | 10/1990 | Redemske et al. | 164/63 |
| 4,982,777 | 1/1991 | Chandley | 164/255 X |

*Primary Examiner*—J. Reed Batten, Jr.

*Attorney, Agent, or Firm*—Reising, Ethington, Barnard, Perry & Milton

[57] ABSTRACT

Casting apparatus for the vacuum-assisted, counter-gravity casting of a melt comprises a porous, gas permeable casting mold including a mold cavity and a melt inlet communicating the mold cavity to a lower mold portion adapted to engage an underlying source of melt and a vacuum box defining a vacuum chamber confronting the casting mold for evacuating the mold cavity when the lower mold portion and the underlying source of the melt are engaged. A valve member is disposed on the mold in an open position relative to the melt inlet to permit the melt to be drawn upwardly therethrough into the mold cavity when the lower mold portion and the source are engaged with the mold cavity evacuated and is movable to a closed position relative to the melt inlet after the mold cavity is filled with the melt to close off the melt inlet to prevent the melt from flowing out of the mold cavity when the lower mold portion and the source are subsequently disengaged. The valve member is movable from the open position to the closed position by a valve moving mechanism carried on the vacuum box. The mold is engaged with the melt source only long enough to fill the mold cavity with the melt to thereby provide a significant reduction in the overall casting cycle time.

12 Claims, 3 Drawing Sheets

VACUUM-ASSISTED COUNTER GRAVITY CASTING APPARATUS WITH VALVE TO PREVENT FLOW OF MELT FROM MOLD

This is a continuation of copending application Ser. No. 07,698,456 filed on May 10, 1991 and now abandoned.

FIELD OF THE INVENTION

The present invention relates to apparatus for the vacuum-assisted, countergravity casting of a melt into a gas permeable mold and, more particularly, to an arrangement of a valve movable on the mold relative to a melt inlet and valve moving means on the vacuum box operative to move the valve to close off the melt inlet after filling a mold cavity to prevent flow of melt therefrom when the mold and an underlying melt source are disengaged after countergravity casting.

BACKGROUND OF THE INVENTION

A vacuum-assisted, countergravity casting process using a gas permeable mold is described in such prior patents as the Chandley et al U.S. Pat. Nos. 4,340,108 issued July 20, 1982 and 4,606,396 issued Aug. 19, 1986. That countergravity casting process involves providing a mold having an expendable porous, gas permeable upper mold member (cope) and an expendable lower mold member (drag) engaged together at a parting plane, sealing the bottom lip of a peripheral wall of a vacuum chamber to the mold such that the vacuum chamber confronts the gas permeable upper mold member, immersing the bottom side of the lower mold member in an underlying pool of melt, and evacuating the vacuum chamber to draw the melt upwardly through one or more melt inlet passages in the lower mold member and into one or more mold cavities formed between the upper and lower mold members.

Typically, this process fills the mold cavities with the melt in a relatively short time, such as approximately 2–3 seconds. However, the mold must remain immersed in the melt until at least the melt in the inlet passages of the mold drag freezes off (solidifies). For example, the mold typically must remain immersed in the melt pool on the order of 15 to 50 seconds after filling of the mold cavities to freeze off (solidify) the melt in the inlet passages. In the event the mold is withdrawn from the melt pool prior to freezing of the melt in the inlet passages, the melt in the inlet passages as well as in the mold cavities can flow downwardly out of the mold and result in a defective casting which must be scrapped. The time required to freeze off the melt inlet passages has thus limited the rate of production of castings using this process.

The Greanias et al U.S. Pat. No. 4,862,945 issued Sept. 5, 1989 illustrates use of a ball check valve in a melt inlet passage of a drag member of a vacuum-assisted, countergravity casting mold assembly to prevent backflow of the melt from the mold cavity when the drag member is withdrawn from the underlying melt pool after filling of the mold cavity and before solidification of the melt in the inlet passages. The drag member is immersed in the melt pool only long enough to fill the mold cavities and thereby reduces the overall casting cycle time to improve the rate of production of castings.

The ball check valve is disposed on a valve seat formed on the drag member so as to lifted off the seat by the upwardly flowing melt during casting to permit filling of the mold cavity with the melt and then is forced downwardly by the head (fluid pressure) of the melt thereabove into sealing engagement with the valve seat after casting as the drag member and the melt pool are disengaged so as to prevent the melt in the mold cavities from draining downwardly out of the mold. Thus, movement of the ball check valve between open and closed positions relative to the valve seat is effected by the melt itself during the casting process.

It is an object of the invention to provide an improved apparatus for the vacuum-assisted, countergravity casting of a melt in reduced casting cycle times by virtue of including a valve movable on a mold relative to a melt inlet of a mold cavity by valve moving means carried on a vacuum box confronting the mold and actuable after the mold cavity is filled with the melt to move the valve to a closed position relative to the melt inlet so as to allow disengagement of the mold and an underlying source of the melt prior to solidification of the melt in the melt inlet without backflow of the melt from the mold cavity.

SUMMARY OF THE INVENTION

The invention contemplates a casting apparatus for the vacuum-assisted, countergravity casting of a melt wherein the apparatus comprises a gas permeable casting mold including a mold cavity and a melt inlet communicating the mold cavity to a lower mold portion adapted to engage an underlying source of melt and a vacuum box defining a vacuum chamber confronting the casting mold for evacuating the mold cavity when the lower mold portion and the underlying source of the melt are engaged. A valve member is disposed at an open position relative to the melt inlet to permit the melt to be drawn upwardly therethrough into the mold cavity when the lower mold portion and the source are engaged with the mold cavity evacuated and is movable on the mold to a closed position relative to the melt inlet after the mold cavity is filled with the melt to close off the melt inlet to prevent the melt from flowing out of the mold cavity when the lower mold portion and the source are subsequently disengaged. The valve member is movable from the open position to the closed position by valve moving means carried on the vacuum box.

In one embodiment of the invention, the valve includes an end portion disposed externally of the mold for engagement by the valve moving means.

In another embodiment of the invention, the end portion of the valve is disposed in the vacuum chamber, and the valve moving means comprises an actuator member in the vacuum chamber movable into engagement with the valve end portion to move the valve member from the open position to the closed position relative to the melt inlet.

In still another embodiment of the invention, the melt inlet comprises an upstanding, elongated passage on the lower mold portion (e.g., the mold drag), and the valve member comprises an upstanding, elongated plug disposed on the mold (e.g., on the mold cope) above the passage at the open position and movable downwardly into the passage to the closed position to plug the passage.

In still another embodiment of the invention, the melt inlet comprises an upstanding, elongated passage on the lower mold portion (e.g., the mold drag), and the valve member comprises a laterally elongated blade valve disposed on mold (e.g., on the mold drag) adjacent the upstanding passage at the open position and movable laterally to a closed position across the passage to close off the passage.

In still a further embodiment of the invention, the valve member is embedded in the mold at an open position relative to the melt inlet and then is moved by the valve moving means to penetrate through the mold material to the closed position relative to the melt inlet after the mold cavity is filled with the melt.

BRIEF DESCRIPTION OF THE DRAWINGS

The objects and advantages of the present invention enumerated above will become more readily apparent from the following detailed description taken in conjunction with the following drawings.

DETAILED DESCRIPTION OF THE INVENTION

Figure 1:
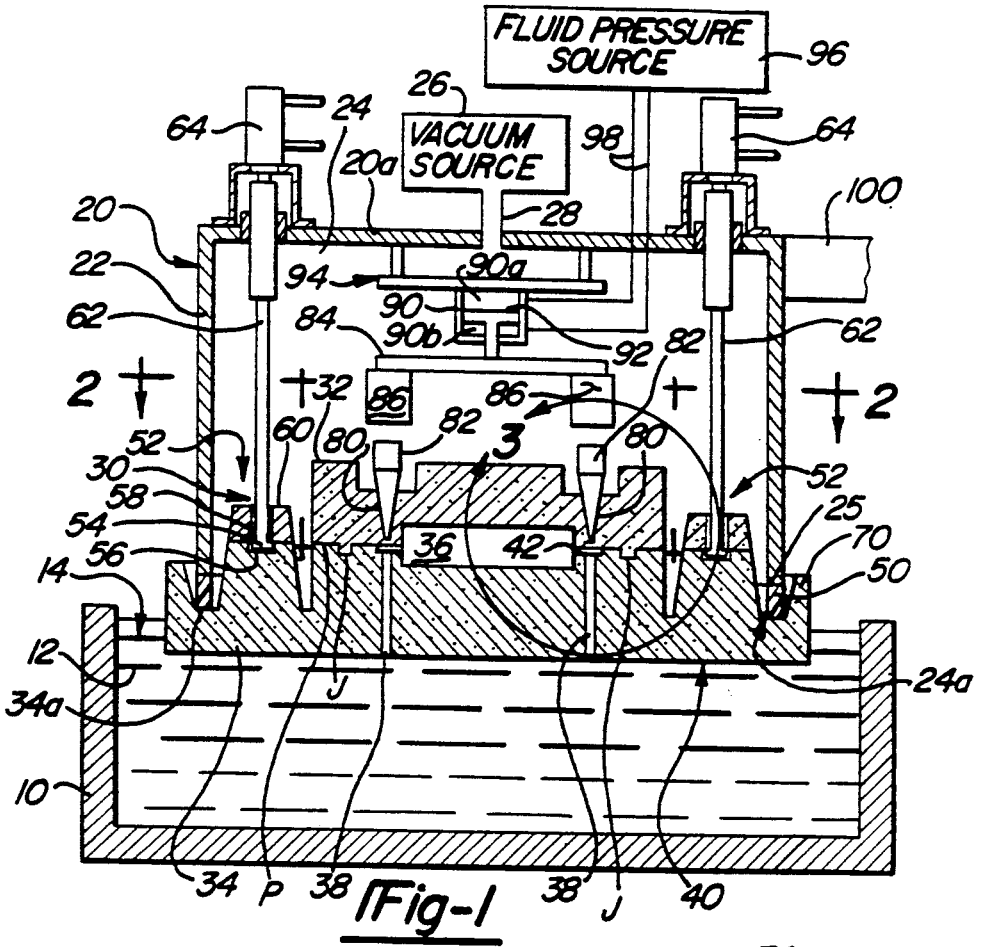
FIG. 1 is a side sectional view of a casting apparatus in accordance with one embodiment of the invention.

FIG. 1 illustrates a casting apparatus in accordance with one embodiment of the invention for the vacuum-assisted, countergravity casting of a melt 12 (e.g., molten metal) contained in a vessel 10 (e.g., a crucible) as a melt pool 14. The casting apparatus includes a vacuum box 20 having a peripheral wall 22 defining a vacuum chamber 24 and a lower lip 25 forming the mouth 24*a* of the vacuum chamber. The vacuum chamber 24 is communicated to a source of vacuum 26 (e.g., a vacuum pump) by a conduit 28 sealingly fastened to the top wall 20*a* of the vacuum box 20.

A casting mold 30 is sealingly received in the vacuum chamber 24 as shown in FIG. 1. The casting mold 30 comprises a porous, gas permeable upper mold member 32 (i.e., cope) and a lower mold member 34 (i.e., drag), which may be gas permeable or impermeable. The mold cope and drag 32,34 may be adhesively secured together along juxtaposed parting surfaces that define a parting plane P having tongue and groove joints J. Defined between the mold cope and drag 32,34 are one or more mold cavities 36 (only one shown) to be filled with the melt 12 through one or more upstanding, elongated lower melt inlet passages 38 (e.g., cylindrical "pin" gates) in the mold drag 34. Each melt inlet passage 38 extends from the drag underside or bottom 40 adapted to be immersed (engaged) in the melt 12 to a respective laterally extending, upper melt inlet passage 42 (e.g., a rectangular "ribbon" gate) that communicates with the mold cavity 36 as shown. The mold cavity 36 can be evacuated through the porous, gas permeable mold cope 32 to urge the melt upwardly through the melt inlet passages 38,42 and into the mold cavity when the drag underside 40 is immersed in the melt 12 as is well known.

The mold drag 34 is sealed to the mouth 24*a* of the vacuum box 20 via a seal 50 (e.g., high temperature rubber, ceramic rope, etc.) affixed to the lower lip 25 of the peripheral wall 22 to this end. The seal 50 is compressed between the lower lip 25 and an upwardly facing sealing surface 34*a* on the mold drag 34 by a mold-to-vacuum box clamping mechanism illustrated as including a plurality of anchoring sites 52 on the mold drag 34 engaged by T-bar keepers 54 in the manner described in U.S. Pat. No. 4,932,461. As described in that patent, the mold drag 34 includes a plurality of anchoring cavities 56 disposed at the sites 52 and adapted to receive the T-bar keepers 54 via slots 58 in shelves 60 overlying the anchoring cavities 56 and attached to the mold drag 34. A 90° rotation of the T-bar carrying shafts 62 (e.g., by air motors 64) causes the T-bar keepers 54 to engage the underside of the attached shelves 60 to secure the mold drag 34 to the vacuum box 20. Other known mold-to-vacuum box clamping means can also be employed in practicing the invention (see U.S. Pat. No. 4,658,880).

The mold drag 34 includes an upstanding levee 70 surrounding the seal 50 and isolating it from heat from and contact with the melt 12 during casting as described in U.S. Pat. No. 4,745,926 of common assignee herewith.

The mold cope and drag 32,34 can be made of resin-bonded foundry sand in accordance with known mold practice wherein a compliant mixture of foundry sand or equivalent particles and a settable bonding material (e.g., an inorganic or organic thermal or chemical setting plastic resin) is formed to shape and cured or hardened against respective contoured pattern plates (not shown) having the desired contour or profile for forming the mold cavity 36, melt inlet passages 38,42, and other features of the cope and drag 32,34.

Figure 3:
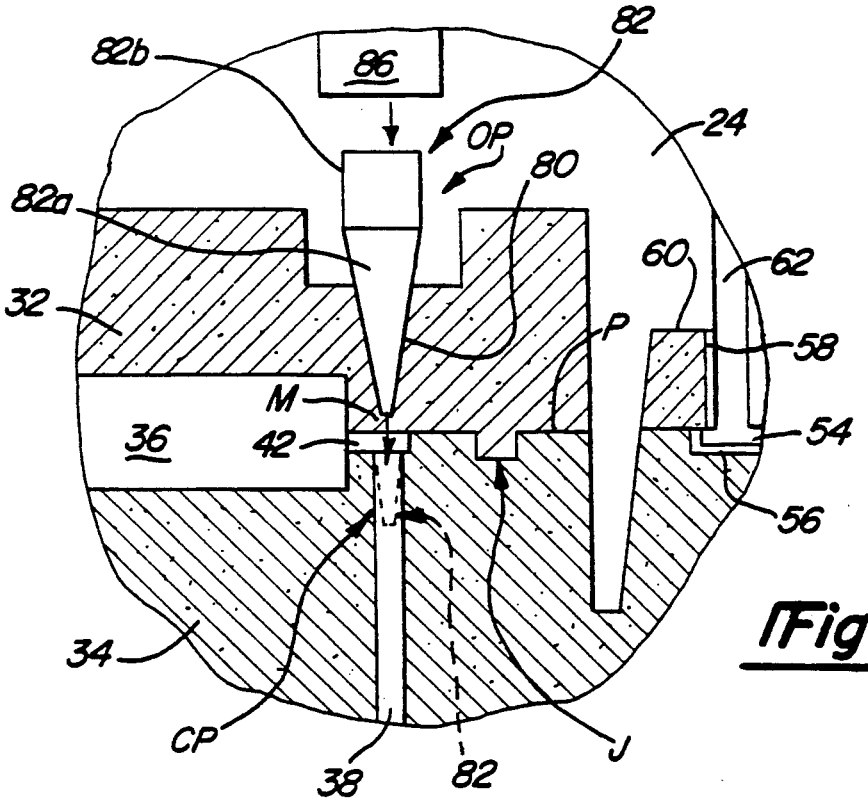
FIG. 3 is an enlarged view of the encircled portion of FIG. 1.

In accordance with one embodiment of the present invention, the mold cope 32 includes a plurality of upstanding, frusto-conical recesses 80 formed (e.g., molded) therein. Each recess 80 is disposed generally coaxially above a respective melt inlet passage 38 as shown in FIG. 1. An upstanding, elongated, reusable, metallic plug valve 82 is received in each recess 80 of the mold cope 32 in an initial open position OP relative to the associated inlet passage 38 therebelow as shown in FIG. 3. Rows of multiple plug valves 82 are thereby provided on opposite sides of the mold cavity 36.

Referring to FIG. 3, each plug valve 82 includes a lower frusto-conical end 82*a* received in a respective recess 80 and a cylindrical upper end 82*b* located in the vacuum chamber 24 above the mold cope 32 when the valve is in the open position OP shown.

The plug valves 82 are movable downwardly on the mold cope 32 to a closed position CP (shown in phantom lines in FIG. 3) into the underlying melt inlet passage 38 by a valve moving means comprising a pusher member 84 carried on the lower end of a double-acting fluid piston or plunger 92 of a fluid cylinder 90. The fluid cylinder/piston 90,92 are carried on the vacuum box 20 inside the vacuum chamber 24 by a support bracket 94 affixed to the top wall 20*a* of the vacuum box 20. The fluid cylinder 90 is supplied with pressurized fluid from a suitable conventional fluid source 96 disposed outside the vacuum box 20 via conduits 98 sealingly mounted on the top wall 20*a* of the vacuum box 20 so that the piston 92 is movable upwardly or downwardly, depending upon which chamber 90*a* or 90*b* of the cylinder 90 is fluid pressurized.

The pusher member 84 includes a pair of laterally spaced actuator plates 86 that overlie a respective row of the plug valves 82 as shown best in FIG. 1.

The fluid cylinder/piston 90/92 are actuated to move the actuator plates 86 into engagement with the upper ends 82*b* of the plug valves 82 to move them in unison from the open positions OP to the closed positions CP, FIG. 3, into a respective melt inlet 38 to close off the inlets 38. The pointed lower end 82*a* of each plug valve 82 penetrates through the mold material M of the cope 32 as the plug valves 82 are moved to the closed positions CP in the melt inlets 38.

Referring to FIG. 1, vacuum-assisted, countergravity casting of the melt 12 into the casting mold 30 is effected by relatively moving the vacuum box 20/mold 30 and the pool 14 to immerse the underside 40 of the mold drag 34 in the melt 12. Typically, the vacuum box 20 is lowered toward the pool 14 via an arm 100 fastened thereon and a hydraulic power cylinder (not shown) connected to the arm 100 as described in U.S. Pat. No. 4,340,108. The vacuum chamber 24 is then evacuated to draw the melt 12 upwardly through the melt inlet passages 38,42 in the mold drag 34 into the mold cavity 36 to fill it with the melt 12. At this point in the casting cycle, the plug valves 82 are in the open positions OP shown in FIGS. 1 and 3 so as to permit the melt 14 to be drawn upwardly into the mold cavity 36.

After the mold cavity 36 is filled with the melt 12 and before the melt 12 in the inlet passages 38,42 and the mold cavity 36 is solidified, the fluid cylinder/piston 90/92 are actuated to move the actuator plates 86 downwardly to engage the upper ends 82*b* of the plug valves 82 and force the valves 82 in unison to penetrate through the mold material M to the closed positions CP in the melt inlet passages 38 to plug (close off) them, FIG. 3. The vacuum chamber 20/mold 30 are then raised to disengage the mold drag 34 from the melt 12. During disengagement, any melt in the lower inlet passages 38 below the closed plug valves 82 will drain back into the pool 14. However, the melt 12 in the mold cavity 36 is prevented from flowing out of the mold by the closed valves 82 plugging or closing off the inlet passages 38. Thus, the mold drag 34 needs to be immersed in the pool 14 only long enough to fill the mold cavity 36 with the melt 12 and need not remain immersed in the pool 14 until the melt 12 in the inlet passages 38 and the mold cavity 36 is solidified. As a result, a significant reduction in the overall casting cycle time is achieved. Moreover, closure of the plug valves 82 is effected in controlled manner by the fluid cylinder/piston 90/92 without reliance on the flow of the melt 14 to do so.

Figure 2:
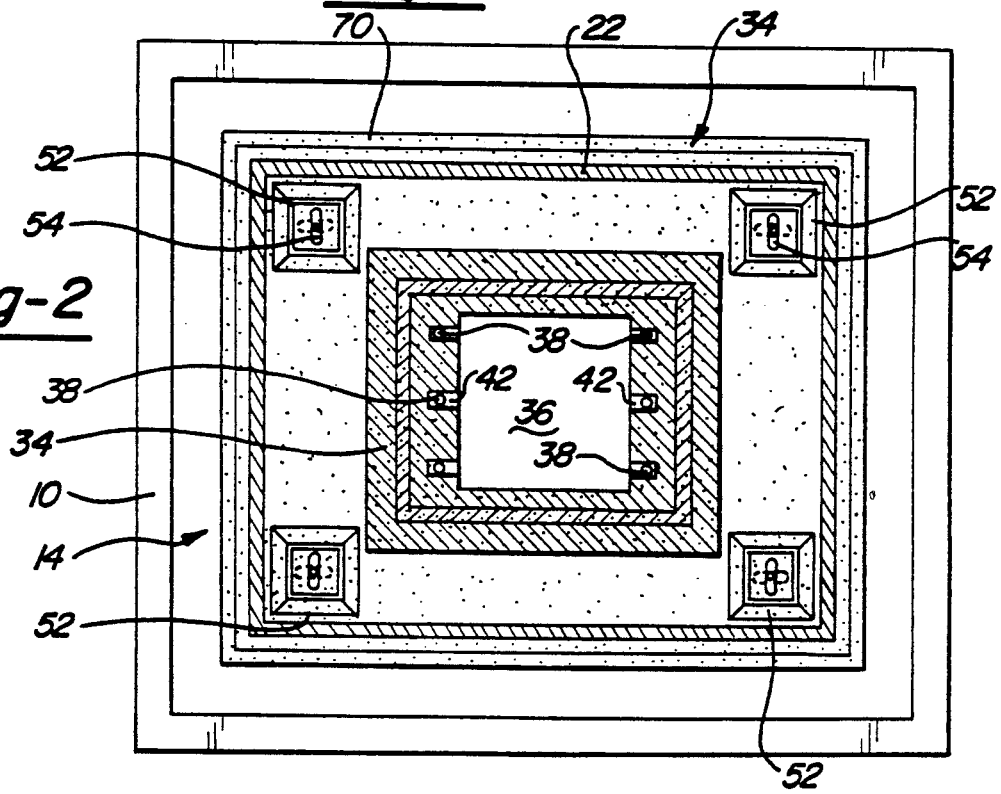
FIG. 2 is sectional view of the casting apparatus taken along lines 2—2 of FIG. 1.
Figure 6:
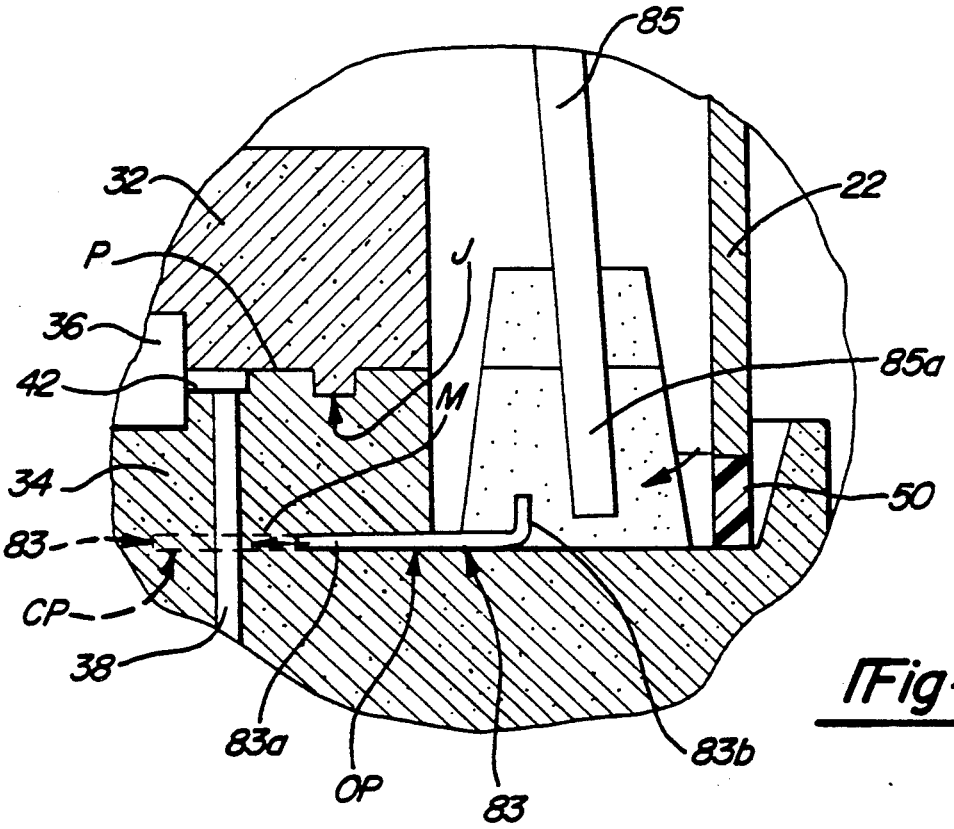
FIG. 6 is an enlarged view of the encircled portion of FIG. 4.
Figure 4:
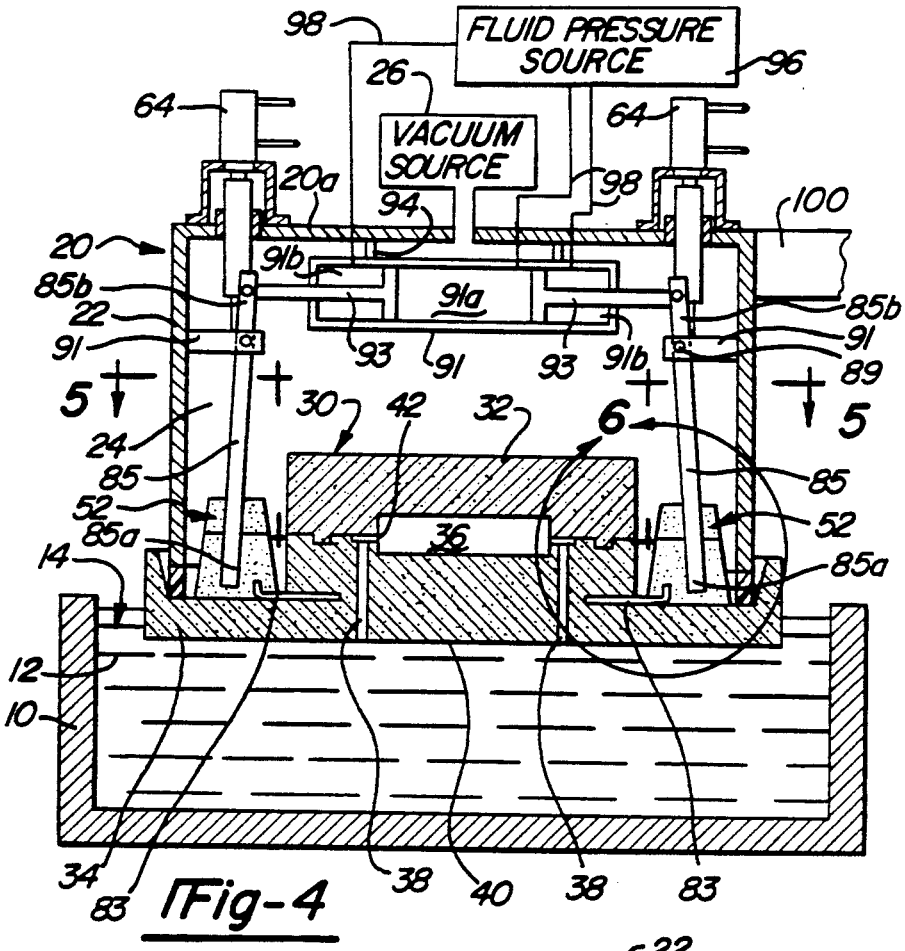
FIG. 4 is a side sectional view of a casting apparatus in accordance with another embodiment of the invention.
Figure 5:
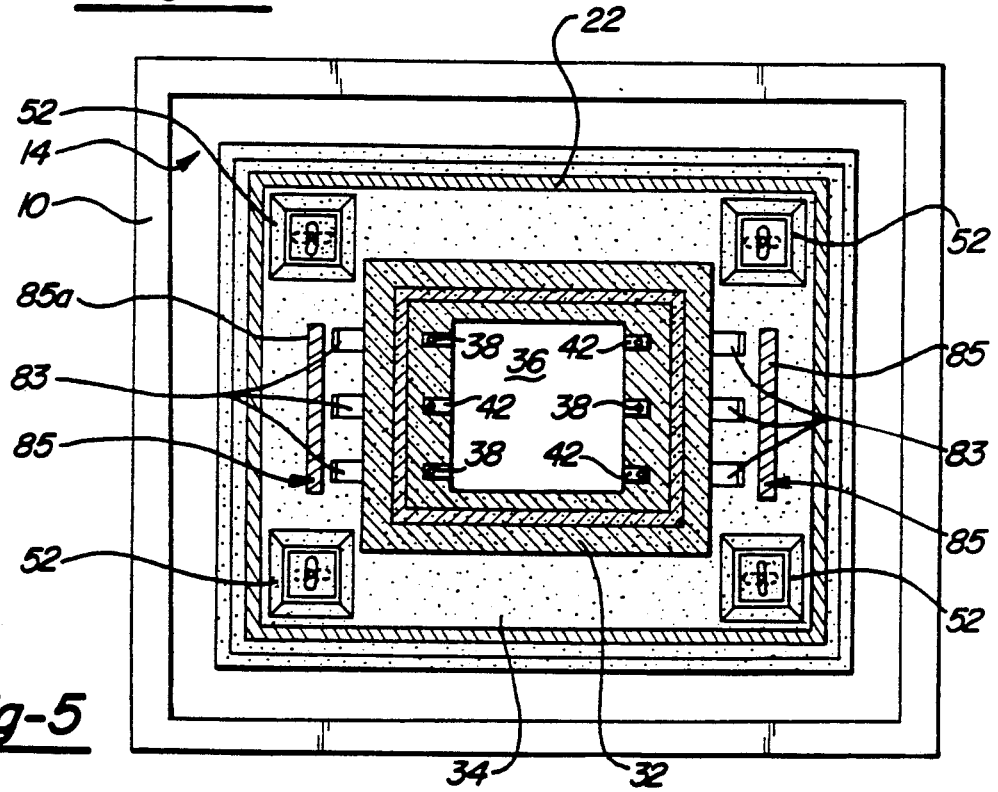
FIG. 5 is sectional view of the casting apparatus taken along lines 5—5 of FIG. 4.

Another embodiment of the present invention is illustrated in FIGS. 4–6 wherein like features of FIGS. 1–3 are represented by like reference numerals. In this embodiment, the mold drag 34 includes a plurality of thin, metallic blade valves 83 embedded therein in an initial open position OP relative to the associated inlet passage 38, FIGS. 4 and 6. In particular, the blade valves 83 are incorporated in the mold drag 34 during molding thereof. For example, the blade valves 83 are fixtured on the mold tooling, and the mold drag 34 is formed (molded) about the fixtured blades 83 in accordance with conventional molding practice. This technique yields a mold drag 34 having the blade valves 83 embedded therein at the initial open position OP adjacent a respective melt inlet passage 38 as shown in FIGS. 4 and 6. Rows of multiple blade valves 83 are thereby provided on opposite sides of the mold as shown in FIGS. 4 and 5.

Referring to FIG. 6, each blade valve 83 includes an inner end 83*a* proximate the respective inlet passage 38 and an upturned outer end 83*b* located in the vacuum chamber 24 laterally adjacent the mold drag 34 when the valve is in the open position OP shown.

The blade valves 83 are movable laterally on the mold drag 34 to a closed position CP (shown in phantom lines in FIG. 6) across the adjacent melt inlet passage 38 by a valve moving means comprising a pair of actuator arms 85 pivotably mounted in the vacuum box 20 by pivot pins 89 and support brackets 91 fastened to the vacuum box 20. Each actuator arm 85 includes a lower end 85*a* proximate a respective row of the blade valves 83 and an upper end 85*b* pivotably connected to a respective double-acting fluid piston or plunger 93 of a fluid cylinder 91. As is apparent, the fluid cylinder/-pistons 91/93 are carried on the vacuum box 20 inside the vacuum chamber 24 by a support bracket 94 affixed to the top wall 20*a* of the vacuum box 20. The fluid cylinder 91 is supplied with pressurized fluid from a suitable conventional fluid source 96 disposed outside the vacuum box 20 via the conduits 98 so that the pistons 93 are movable in opposite lateral directions, depending upon which of chamber 91*a* or chambers 91*b* of the cylinder 91 is/are fluid pressurized.

The inner end 83*a* of each blade valve 83 penetrates through the mold material M of the drag 34 as the blade valves 83 are moved laterally by the actuator arms 85 to the closed positions CP across the melt inlets 38.

Referring to FIG. 4, vacuum-assisted, countergravity casting of the melt 12 into the casting mold 30 is effected by relatively moving the vacuum box 20/mold 30 and the pool 14 to immerse the underside 40 of the mold drag 34 in the melt 12. The vacuum chamber 24 is then evacuated sufficiently to draw the melt 12 upwardly through the melt inlet passages 38,42 in the mold drag 34 into the mold cavity 36 to fill it with the melt 12. At this point in the casting cycle, the blade valves 83 are in the open positions OP shown in FIGS. 4 and 6 so as to permit the melt 12 to be drawn upwardly into the mold cavity 36.

After the mold cavity 36 is filled with the melt 12 and before the melt 12 in the inlet passages 38,42 and the mold cavity 36 is solidified, the fluid cylinder/pistons 91/93 are actuated to move the lower ends 85*a* of the actuator arms 85 laterally to engage the outer ends 83*b* of the adjacent blade valves 83 and force the valves 83 to penetrate through the mold material to the closed positions CP across the melt inlet passages 38 to close them, FIG. 6. The vacuum chamber 20/mold 30 are then raised to disengage the mold drag 34 from the melt 12. During disengagement, any melt in the lower inlet passages 38 below the closed blade valves 83 will drain back into the pool 14. However, the melt 12 in the mold cavity 36 is prevented from flowing out of the mold by the valves 83 closing off the inlet passages 38. Thus, the mold drag 34 needs to be immersed in the pool 14 only long enough to fill the mold cavity 36 with the melt 12 so as to significantly reduce the overall casting cycle time. Moreover, closure of the blade valves 83 is effected in a controllable manner by the fluid cylinder/-pistons 91/93 without reliance on the flow of the melt 12 to do so.

Although the embodiments of the invention described above employ a valve moving means inside the vacuum chamber 22 to engage ends of the valve members 82,83 also located inside the vacuum box 20, the invention is not so limited and may be practiced using valve moving means located externally of the vacuum box 20 to engage ends of the valve members 82,83 that are also located externally of the vacuum box 20. For example, the valves 83 in FIGS. 4–6 may extend sealingly and laterally through the peripheral wall 22 of the vacuum box 20 to the exterior thereof for engagement by valve moving means mounted on the exterior of the vacuum box 20.

While the invention has been described in terms of specific embodiments described in detail above, it is not intended to be limited thereto but rather only to the extent set forth hereafter in the claims which follow.

We claim:

1. Countergravity casting apparatus, comprising:

a) a gas permeable casting mold defining a mold cavity and a melt inlet passage communicating the mold cavity to a lower mold portion adapted to engage an underlying source of melt, b) a vacuum box defining a vacuum chamber confronting the casting mold for evacuating the mold cavity when the lower mold portion and the underlying source of the melt are engaged, c) a valve member carried by said mold for closing off said passage and blocking the backflow of melt from said mold cavity when said cavity is filled with melt, said member being (1) disposed in said mold in a first position adjacent said passage during filling of said mold cavity so as not to restrict the melt from being drawn upwardly through said passage into the mold cavity when the lower mold portion and the source are engaged with the mold cavity evacuated and (2) movable to a second position inside said passage after the mold cavity is filled with the melt to block the backflow of melt from the mold cavity when the lower mold portion and the source are disengaged, and d) means carried on the vacuum box for engaging and moving said valve member from said first position in said mold to said second position in said passage after the mold cavity is filled with the melt.

2. The apparatus of claim 1 wherein the valve member is disposed on the casting mold in the open position and is movable on the mold to the closed position after the mold cavity is filled to close off the melt inlet.

3. The apparatus of claim 2 wherein the valve member includes an end portion disposed externally of the mold in the valve open position for engagement by said valve moving means.

4. The apparatus of claim 3 wherein the end portion of the valve is disposed in the vacuum chamber.

5. The apparatus of claim 4 wherein the valve moving means comprises an actuator member in the vacuum chamber movable into engagement with the valve end portion to move the valve member from the open position to the closed position, and means for moving the actuator member.

6. The apparatus of claim 1 wherein the valve member is embedded in the mold spaced from the melt inlet passage at the open position and then is moved to penetrate through the mold after the mold cavity is filled with the melt to the closed position to close off the melt inlet passage.

7. The apparatus of claim 1 wherein the melt inlet comprises an upstanding, elongated passage on the lower mold portion, and the valve member comprises an upstanding, elongated plug disposed above said passage in the open position and movable downwardly into said passage in the closed position to plug said passage.

8. The apparatus of claim 7 wherein the mold comprises an upper cope and a lower drag, said passage being disposed on the drag and said plug being disposed on the cope in the open position.

9. The apparatus of claim 1 wherein the melt inlet comprises an upstanding, elongated passage on the lower mold portion, and the valve member comprises a laterally elongated blade spaced adjacent the upstanding passage at the open position and movable laterally to a closed position across the passage to close off said passage.

10. The apparatus of claim 9 wherein the mold comprises an upper cope and a lower drag, said passage and said blade being disposed on the drag.

11. Countergravity casting apparatus, comprising:

a) a gas permeable casting mold comprising gas permeable cope at least in part defining a mold cavity and a drag having a plurality of melt inlets communicating the mold cavity to a lower portion of the drag adapted to engage an underlying source of melt, b) a vacuum housing box sealingly engaging the mold and defining a vacuum chamber confronting the cope for evacuating the mold cavity when the lower drag portion and the underlying source of the melt are engaged, c) a plurality of valve members disposed on the cope with each valve member disposed in an open position above a respective melt inlet to permit the melt to be drawn upwardly therethrough into the mold cavity when the lower drag portion and the source are engaged with the mold cavity evacuated and movable downwardly to a closed position into each respective melt inlet after the mold cavity is filled with the melt to close off each melt inlet to prevent the melt from flowing out of the mold cavity when the lower drag portion and the source are disengaged, each valve member having an end portion located externally of the cope, and d) means carried on the vacuum box for engaging the end portion of each valve member so as to move each valve member to the closed position in each respective melt inlet after the mold cavity is filled with the melt.

12. Countergravity casting apparatus, comprising:

a) a gas permeable casting mold comprising gas permeable cope at least in part defining a mold cavity and a drag having a plurality of melt inlets communicating the mold cavity to a lower portion of the drag adapted to engage an underlying source of melt, b) a vacuum box sealingly engaging the mold and defining a vacuum chamber confronting the cope for evacuating the mold cavity when the lower drag portion and the underlying source of the melt are engaged, c) a plurality of valve members disposed on the drag with each valve member disposed in an open position spaced laterally of a respective melt inlet to permit the melt to be drawn upwardly therethrough into the mold cavity when the lower drag portion and the source are engaged with the mold cavity evacuated and movable to a closed position laterally across each respective melt inlet after the mold cavity is filled with the melt to close off each melt inlet to prevent the melt from flowing out of the mold cavity when the lower drag portion and the source are disengaged, each valve member having an end portion located externally of the drag, and d) means carried on the vacuum box for engaging the end portion of each valve member so as to move each valve member to the closed position across each respective melt inlet after the mold cavity is filled with the melt.

* * * * *